US012612836B2

(12) United States Patent
El-Sayed

(10) Patent No.: US 12,612,836 B2
(45) Date of Patent: Apr. 28, 2026

(54) THROUGH BOP LUBRICATION SYSTEM

(71) Applicant: Abu Dhabi National Oil Company, Abu Dhabi (AE)

(72) Inventor: Laith Taissir El-Sayed, Abu Dhabi (AE)

(73) Assignee: Abu Dhabi National Oil Company, Abu Dhabi (AE)

( * ) Notice: Subject to any disclaimer, the term of this patent is extended or adjusted under 35 U.S.C. 154(b) by 0 days.

(21) Appl. No.: 17/636,282

(22) PCT Filed: Aug. 22, 2019

(86) PCT No.: PCT/IB2019/057076

§ 371 (c)(1),
(2) Date: Feb. 17, 2022

(87) PCT Pub. No.: WO2021/033013

PCT Pub. Date: Feb. 25, 2021

(65) Prior Publication Data

US 2022/0290524 A1 Sep. 15, 2022

(51) Int. Cl.
*E21B 33/068* (2006.01)
*E21B 33/06* (2006.01)

(52) U.S. Cl.
CPC ..... *E21B 33/068* (2013.01); *E21B 33/06* (2013.01)

(58) Field of Classification Search
CPC ... E21B 33/00; E21B 7/00; E21B 7/01; E21B 15/02; E21B 15/04; E21B 19/002;
(Continued)

(56) References Cited

U.S. PATENT DOCUMENTS 3,100,015 A * 8/1963 Regan ..... E21B 19/00 166/85.3
3,459,259 A * 8/1969 Matthews ..... E21B 7/128 166/359

(Continued)

FOREIGN PATENT DOCUMENTS

WO 2006014544 A2 2/2006
WO 2006033906 A2 3/2006
WO 2015086656 A2 6/2015

OTHER PUBLICATIONS

International Search Report and Written Opinion of the International Searching Authority for corresponding International Patent Application No. PCT/IB2019/057076, dated Jan. 28, 2020.

(Continued)

*Primary Examiner* — Yanick A Akaragwe
(74) *Attorney, Agent, or Firm* — Renner, Otto, Boisselle & Sklar, LLP

(57) ABSTRACT

The present invention relates to a through BOP lubrication system, which is capable to be run-through a rig blow out preventer BOP, located below the rig floor, the through BOP lubrication system comprising a lubricator having a polished rod, wherein the polished rod at the bottom end thereof comprising a first high torque connection for connection with a dry rod; a riser for connecting the lubricator with the well tubing, wherein the riser is capable of running through a blowout preventer stack; a dry rod, which is arranged within the riser; and wherein the dry rod at the top end thereof comprises a second high torque connection, wherein the dry rod is connected to the polished rod of the lubricator via the first and second high torque connections.

13 Claims, 8 Drawing Sheets

Figure 1:
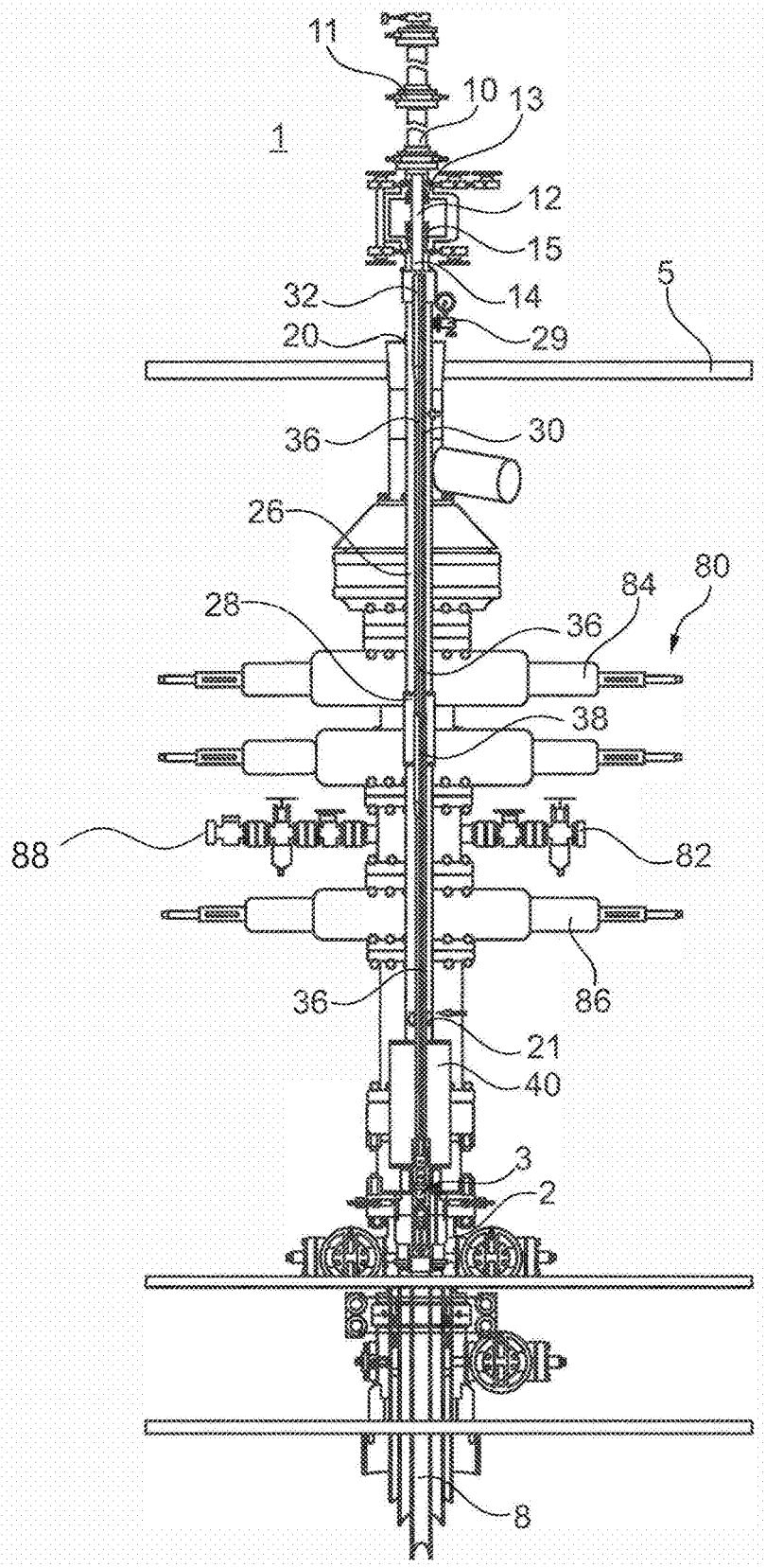

(58) Field of Classification Search
CPC ..... E21B 19/004; E21B 19/006; E21B 34/04; E21B 41/00; E21B 41/04; E21B 41/06; E21B 41/08; E21B 41/10; E21B 43/01
See application file for complete search history.

(56) References Cited

U.S. PATENT DOCUMENTS 3,924,678 A * 12/1975 Ahlstone ..... E21B 33/043 166/120
6,059,042 A * 5/2000 Huber ..... E21B 33/072 166/85.1
6,371,207 B1 * 4/2002 Reynolds ..... E21B 21/00 166/173
6,374,914 B1 4/2002 Wong et al.
6,755,244 B1 * 6/2004 Koopmans ..... E21B 33/068 166/70
2003/0121666 A1 * 7/2003 Boyd ..... E21B 33/072 166/344
2005/0013670 A1 * 1/2005 Guesnon ..... F16L 9/147 405/224.2
2005/0133216 A1 * 6/2005 Bartlett ..... E21B 33/043 166/66.4
2008/0173441 A1 * 7/2008 Bowles ..... E21B 19/08 166/70
2012/0024521 A1 2/2012 Villa
2013/0098632 A1 * 4/2013 Wetzel ..... E21B 43/128 166/85.1
2013/0311097 A1 * 11/2013 Livesay ..... E21B 33/0355 702/11
2016/0060977 A1 * 3/2016 Plain ..... E21B 19/09 166/355

OTHER PUBLICATIONS

Examination and Search Report issued for corresponding UAE Application No. P6000296/2022, mailed May 27, 2024.

* cited by examiner

THROUGH BOP LUBRICATION SYSTEM

This application is a national phase of International Patent Application No. PCT/IB2019/057076, filed on Aug. 22, 2019, the entire disclosure of which is hereby incorporated by reference.

TECHNICAL FIELD

The present invention relates to a through BOP Lubrication System that allows for a positioning and testing of elements through a Blow Out Preventer stack (BOP) through a full pressure control system.

BACKGROUND

In all wells, producers and injectors, pressure control equipment is required during any operation to allow well control and perform the operations safely. As per the international operations standards and the standard of any operator, two barriers between the well bore and surface must be available during all operations.

An operation step of concern is prior to nipple down the Blow Out Preventers (BOP) and installation of the X-mas tree or vice versa. The second barrier, beside the tested plug or DHSV, is usually a plugging device that is arranged in the tubing hanger profile such as a one way Back Pressure Valve (BPV) or a Two Ways Check Valve (TWCV).

Currently while the rig Blow Out Preventers (BOP) is on top of the well head, and the elevation from rig floor rotary table to the tubing hanger can vary from 30 ft to 110 ft, installing any of the plugging devices in the tubing hanger profile is performed using a dry rod, wherein slim pipe joints are connected together by pin or thread and are then welded, with a bottom connection allowing make up tubing hanger plugs and a running/retrieving tool which is operated manually.

A challenge exists with maintaining pressure control during installation and retrieving of the Back Pressure Valve (BPV) or any other plugging device from the tubing hanger profile that will act as secondary well barrier.

In new wells where the completion string is just landed and tested the last operation before nipple up the X-mas tree is to install a tubing hanger back pressure valve (BPV) or any other plugging device, as a secondary barrier prior to nipple down the Blow Out Preventers (BOP). Installing the back pressure valve (BPV) or any other plugging device thru the drilling Blow Out Preventer (BOP) is usually done using a dry rod, were the Blow Out Preventers (BOP) does not provide any seal on the dry rod. If at this stage the Down Hole Safety Valve (DHSV) fails for any reason, there will be no barrier or any pressure control device allowing control the well and contain the hydrocarbon.

Further, in old wells where workover is required the first operation after nipple up, the Blow Out Preventers (BOP) will be recover tubing hanger Back Pressure Valve (BPV) or any other plugging device. At this stage the well has been killed and controlled with kill fluid and sometimes with down hole plugs or by a tested Down Hole Safety Valve. But the string condition may be not known, particularly it might be not known if it is under flow or has losses, as such condition might change while removing the old X-Mas tree and installing the Blow Out Preventers (BOP). Therefore, using the dry rod to remove the Back Pressure Valve from tubing hanger is considered as a high risk operation which may cause a personnel injury and/or may cause an environmental impact.

Thus, from safety perspective, using dry rod can introduce the following risks whenever it is used. First the risk of an environmental impact is given, if hydrocarbon is released to the sea, soil and atmosphere. Further the risk of a personnel injury is given which can take place for example while running dry rod manually as it can fall and hit the person around. Further, the risk occurs that personnel gets hurt and injured if trapped pressure below the tubing hanger plug is released suddenly while attempting to release the tubing hanger plug.

The prior art document US 2012 0024521 A1 discloses a lubricator system to use at a wellhead (oil or natural gas well). In this system a polished rod of the lubricator is disposed with a BPVs for its placement. Further, a piston is provided which is connected to the polished rod to cause the rod to move up and down to place and retrieve BPVs.

SUMMARY OF THE INVENTION

The present invention solves the above-mentioned problems by a through Blow Out Preventer (BOP) lubrication system according to claim 1.

Particularly, a through BOP lubrication system according to the invention, which is capable to be run through a rig blow out preventer located below the rig floor, the through BOP lubrication system comprises a lubricator having a polished rod, wherein the polished rod at the bottom end thereof comprising a first high torque connection for connection with a dry rod; a riser for connecting the lubricator with the well tubing, wherein the riser is capable of running through a blow out preventer stack; a dry rod, which is arranged within the riser; and wherein the dry rod at the top end thereof comprises a second high torque connection, wherein the dry rod is connected to the polished rod of the lubricator via the first and second high torque connections.

The through Blow Out Preventers (BOP) Lubrication System provides a full pressure control system and manages well pressure when it becomes necessary. It can be run thru the rig Blow Out Preventers (BOP) from rig floor to provide smooth access to the tubing hanger plug profile allowing run and retrieve Back Pressure Valves (BPV's) or tubing hanger plugs with full pressure control capability and with ability to contain any hydrocarbon flux that can flow thru the tubing hanger and rig Blow Out Preventers (BOP) stack. Thereby, the lubricator allows exact placing and testing of for example back pressure valves or other elements attached to the dry rod through the BOP stack.

Contrary to the prior art, the present invention uses a dry rod for BPVs placement, wherein the dry rod is in high torque connection with the polished rod of the lubricator. Therefore, the top most connection of the dry rod is be compatible with the lubricator polished rod connection. Further, a riser allows a smooth access to tubing hanger to install and retrieve BPVs since the riser with different length and different bottom subs or joints.

Preferably, the riser comprises a plurality of riser tube elements, that are connected to each other via high pressure rating riser joints. Thus, the riser can be adapted to the desired height for locating the lubricator above the rig floor.

Preferably, the top most riser tube element comprises a pressure gauge. By the pressure gauge the pressure within the riser can be measured. This allows for testing the pressure integrity of the BOP and other elements of the wellhead. Further the pressure gauge will allow a continuous monitoring of the well head pressure after removing the tubing hanger plugging device.

Preferably, the lower most riser tube element comprises inlet holes.

Preferably, the riser further comprises a riser bottom sub element designed for a single completion tubing hanger, for connecting the riser with a single well tubing hanger plug profile. Such riser single bottom sub element provides a smooth access to tubing hanger for a single tubing.

Alternatively, the riser further comprises a riser bottom sub element designed for a dual completion tubing hanger, for connecting the riser with a dual well tubing hanger plug profile. Such riser dual bottom sub element provides a smooth access to tubing hanger for a dual tubing.

Preferably, the dry rod comprises a plurality of dry rod tube elements, that are connected to each other via high torque rating dry rod joints. Thus, the dry rod can be adapted to the desired length for positioning e.g. a back pressure valve below a BOP stack and the lubricator above the rig floor.

Preferably, the lower most dry rod tube element, comprises at the bottom end thereof a socket head, for connection with a running or retrieving tool.

Preferably, the lubricator comprises a housing, an upper packing and a lower packing, wherein the upper and lower packings seal the polished rod against the housing.

Preferably, the lubricator further comprises a hydraulically actuated middle packing that further seals the polished rod against the housing, wherein the middle packing is arranged in-between the lower and the upper packing of the lubricator.

Preferably, the through BOP lubrication system further comprises a C-plate.

Preferably, the through BOP lubrication system further comprises a dry rod lifting cap for lifting the dry rod.

Preferably, the through BOP lubrication system further comprises a riser lifting cap for lifting the riser.

The above mentioned problems are further solved by a method of testing a through BOP lubrication system, comprising the following steps in the following sequence:

a. run a riser to above tubing hanger orient bottom sub & land same on tubing hanger;
b. close bottom pipe rams;
c. run a dry rod;
d. connect a polished rod of a lubricator to the top of the dry rod;
e. connect the riser with the lubricator; and close the top pipe rams
f. apply pressure through a kill line between the BOP pipe rams and the lubricator lower packing; and
g. check pressure at the BOP gauges and at a riser pressure gauge arranged below the lubricator.

This allows for testing the extended lubrication system while retrieving for example a H2 TWCV.

Preferably, the method of testing a through BOP lubrication system further comprises the following step:

h. after step a, connect a H1 or H2 and running tool to the bottom of dry rod.

This allows for testing the extended lubrication system while running a H1 or H2 back pressure valve or while retrieving for example a H1 tool.

SHORT DESCRIPTION OF THE DRAWINGS

Figure 2:
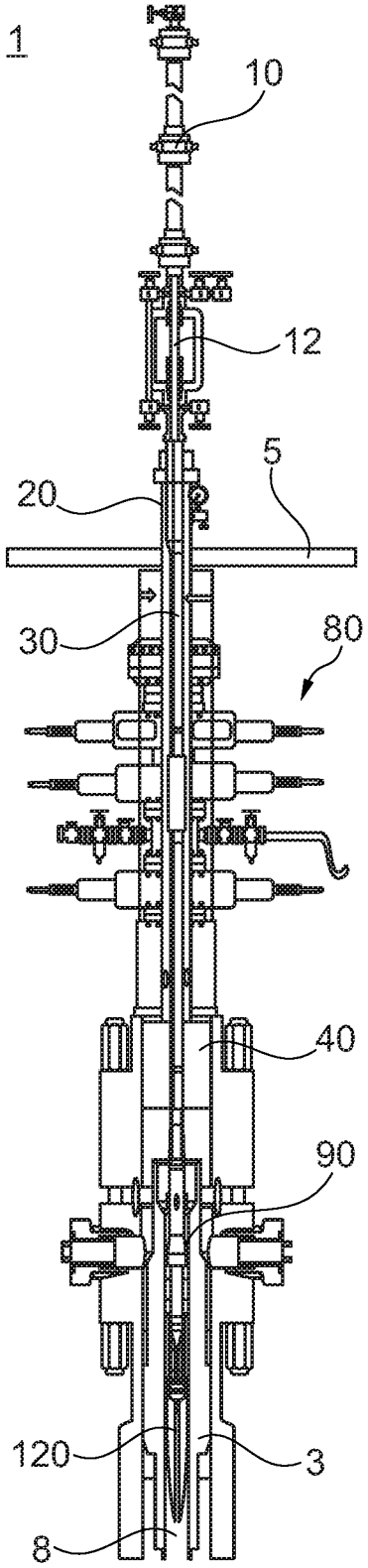
Figure 3:
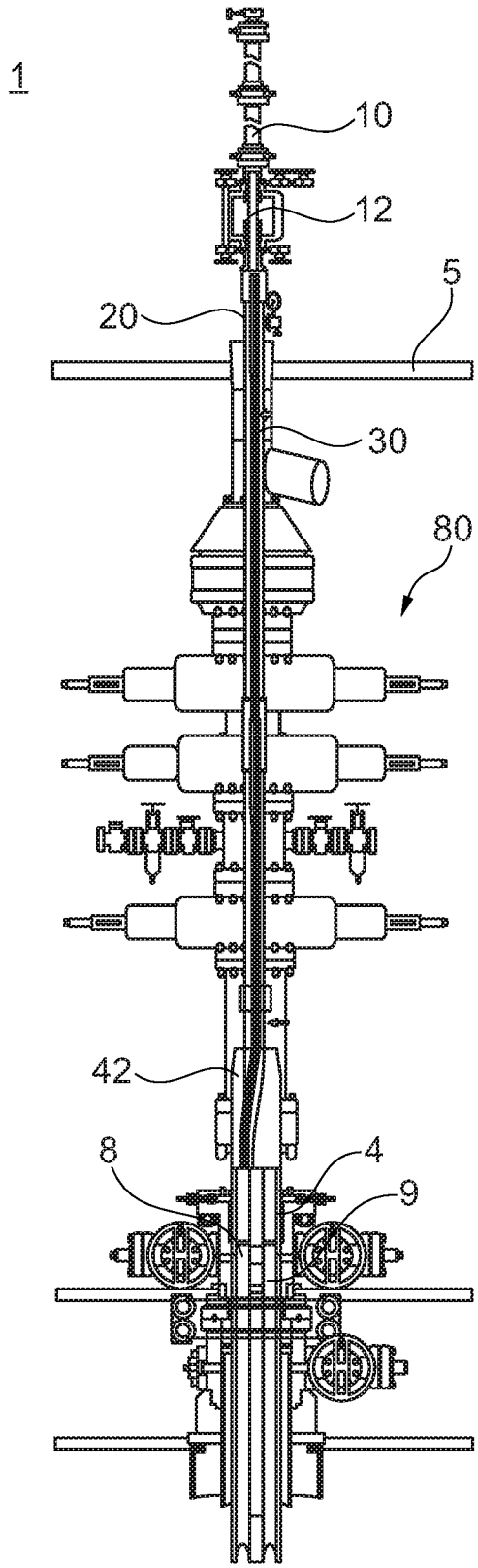
Figure 4:
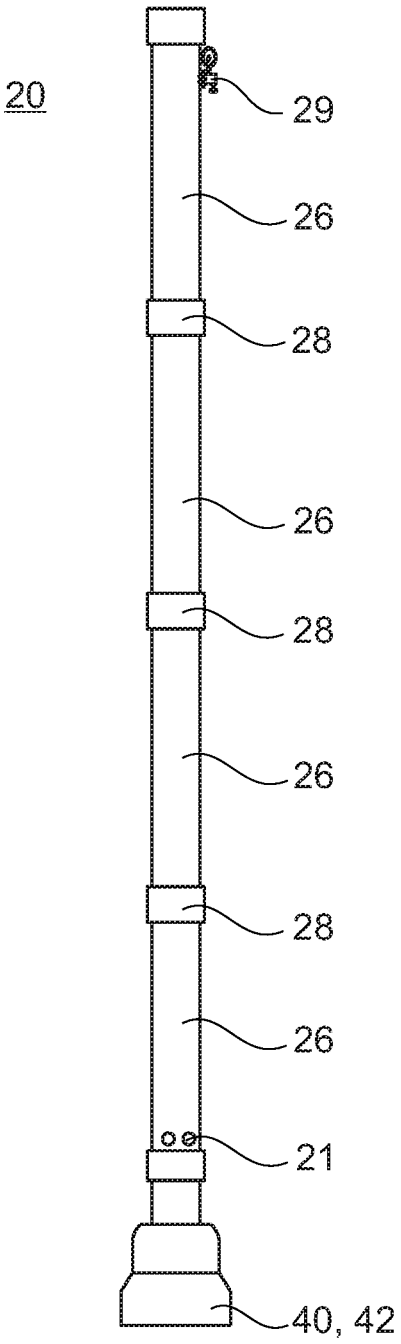
Figure 5:
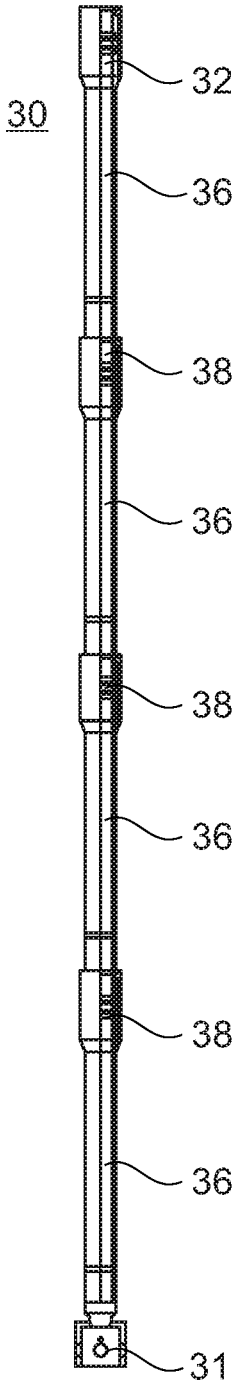
Figure 6:
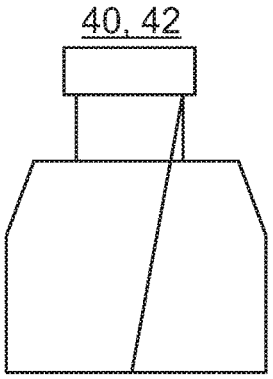
Figure 7:
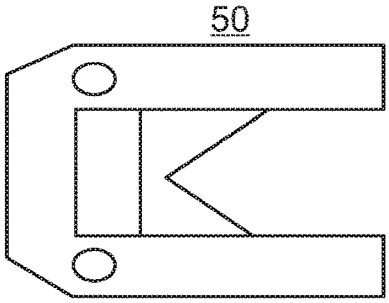
Figure 8:
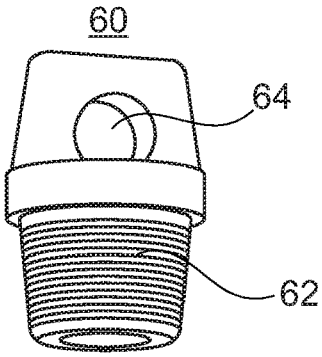
Figure 9:
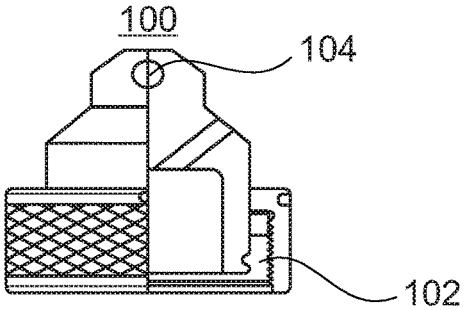
Figure 10:
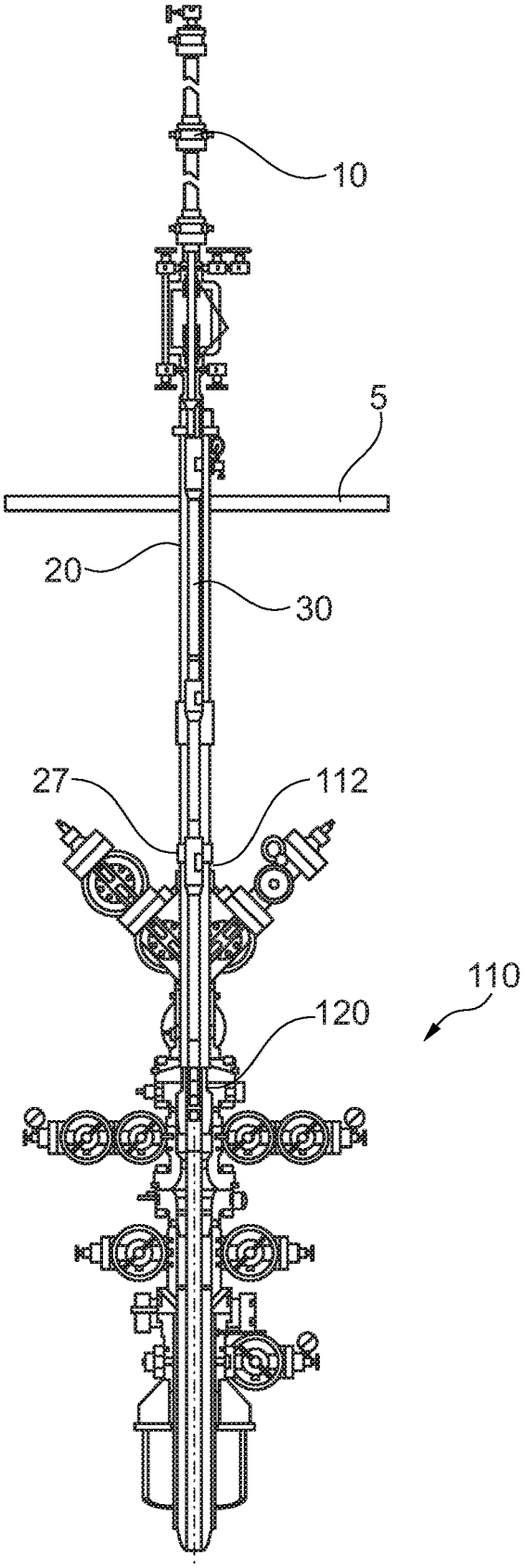
Figure 11:
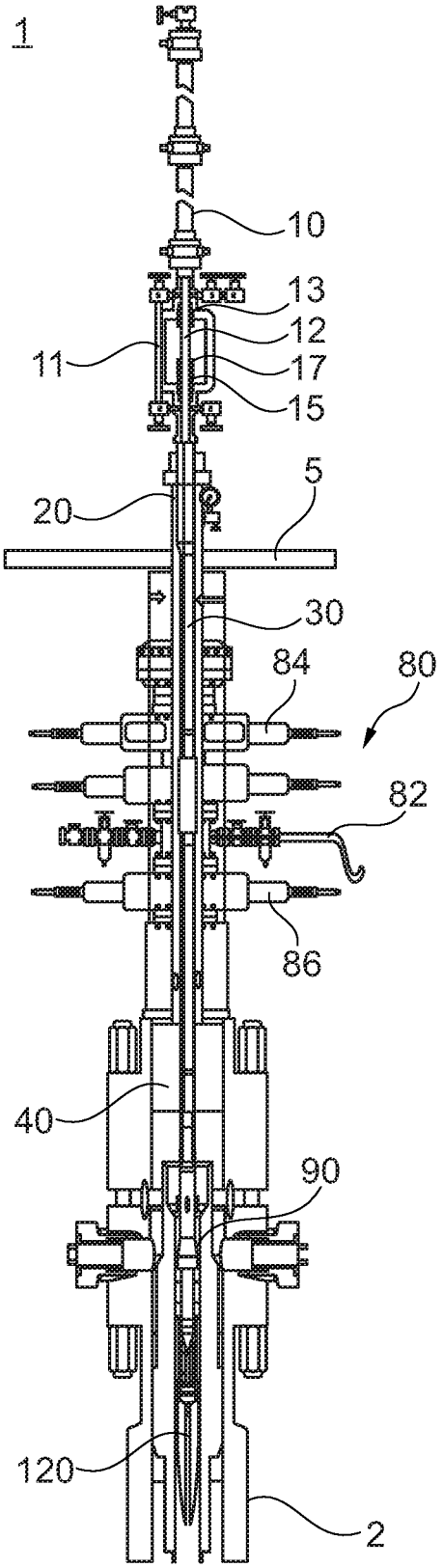
Figure 12:
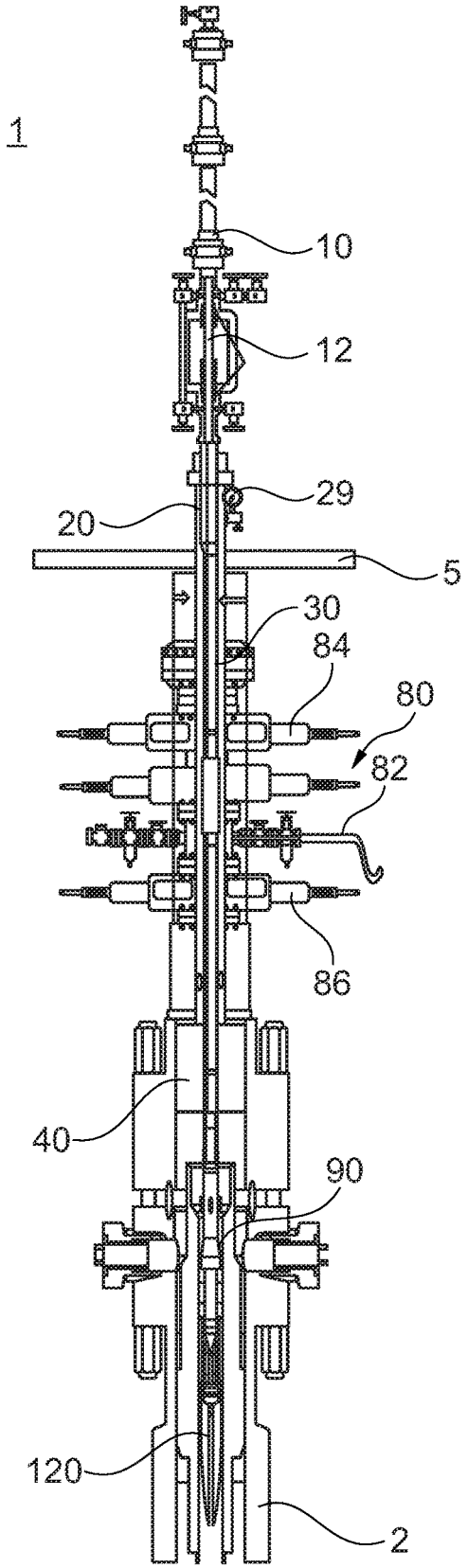

In the following preferred embodiments of the invention are described with respect to the drawings. In which shows:

FIG. 1 a partially sectional side view of a well head including a preferred embodiment of a general lay out of a through BOP lubrication system;

FIG. 2: a partially sectional detailed side view of a well head including a preferred embodiment of a through BOP lubrication system connected to a back pressure valve;

FIG. 3: a partially sectional detailed side view of a well head including a preferred embodiment of a through BOP lubrication system with a dual well tubing hanger;

FIG. 4: a side view of a preferred embodiment of a riser;

FIG. 5: a side view of a preferred embodiment of a dry rod;

FIG. 6: a side view of a preferred embodiment of a well tubing hanger;

FIG. 7: a side view of a preferred embodiment of a C-plate;

FIG. 8: a side view of a preferred embodiment of a dry rod lifting cap;

FIG. 9: a side view of a preferred embodiment of a riser lifting cap;

FIG. 10: a partially sectional detailed side view of a well head including a preferred embodiment of a through BOP lubrication system running through a x-mas tree; and FIGS. 11 and 12: partially sectional detailed side views of a well head including a preferred embodiment of a through BOP lubrication system of FIG. 2 during testing the through BOP lubrication system.

DESCRIPTION OF PREFERRED EMBODIMENTS

In the following preferred embodiments of the invention are described with respect to the drawings.

FIG. 1 shows a well head wherein a through BOP lubrication system 1 is installed on top and running through a BOP stack 80. The through BOP lubrication system 1 is a complete system of high pressure rated equipment assembled together to provide full pressure control system during installing and retrieving the Back Pressure Valve (BPV) 120 or any other plugging device in the tubing hanger profile that will act as secondary well barrier.

The through BOP lubrication system 1 generally comprises a lubricator 10, a riser 20 for connecting the lubricator 10 with a well tubing 2, and a dry rod 30 which is arranged within the riser 20 for placing tools within the tubing 2. The dry rod 30 is connected at its top end thereof with a polished rod 12 of the lubricator 10.

The lubricator 10 comprises a polished rod 12 that can be moved up and down even under pressure. Therefore, the lubricator 10 comprises one or more seals 15, 15, 17 for sealing the polished rod against a lubricator housing 11. Preferably the lubricator 10 comprises an upper packing 13, a lower packing 15 and a middle packing 17 that seal the polished rod against the housing of the lubricator 10. The upper packing 13 is arranged at a higher position than the middle packing 17 which is arranged higher than the lower packing 15. Preferably the middle packing 17 is an hydraulically actuated pack off element to allow test the integrity of the connection between the lubricator and the riser. The lubricator 10 is preferably a high pressure lubricator. The polished rod 12 of the lubricator 10 comprises at the lower end thereof a first high torque connection 14 that is compatible a dry rod 30 for a connection with back pressure valves (BPV) and Two Way Check Valves (TWCV) as well a running and pulling tools. The first high torque connection 14 will be high torque connection with a locking mechanism allowing rotating the string to tight or release the tubing hanger plugs.

The riser 20 connects the lubricator 10 with the well tubing 2. The riser 20 is capable of running through the BOP stack 80 and lifts the lubricator 10 above the rig floor 5. As shown in FIG. 4 the riser 20 comprises a plurality of riser tube elements 26 that are connected to each other via high pressure rating riser joints 28. Preferably high pressure riser joints 28 with different lengths are provided to give flexibility in spacing out between rig floor 5 and a tubing hanger 3, 4 based on rig elevation. The most top riser joint 28 comprises a high pressure gauge 29 and preferably a needle valve to allow monitoring the pressure inside the riser 20 prior breaking out the connection between the riser 20 and lubricator 10. The lower most riser tube element 26 has inlet holes 21, preferably at the lower riser joint thereof is ported, to allow testing the system through Blow Out Preventers (BOP) 80 kill line 82 and also will allow pumping down tubing hanger Back Pressure Valve (BPV) 120 if required to control the well pressure which might be trapped below Back Pressure Valve (BPV) 120.

The riser 20 further comprises a bottom sub element 40, 42, which is shown individually in FIG. 6. The bottom sub element 40, 42 provides a non sealing sub or joint. It preferably has an outer diameter equal to the tubing hanger outer diameter. The bottom sub element 40, 42 provides centralization to the riser 20 while running thru Blow Out Preventers (BOP) stack 80 and further provides smooth access to the tubing hanger profile to install or remove the plugs. The bottom sub element 40 of FIG. 2 connects the riser 20 with a single well tubing hanger plug profile 3.

The bottom sub element 42 of FIG. 3 connects the riser 20 with a dual well tubing hanger plug profile 4 for two tubes 8, 9. For the dual tubing hanger plug profile 4 the bottom sub element 42 has a half-moon blank section to provide access to one tubing hanger profile while blanking the other half of the tubing hanger.

The dry rod 30 connects the polished rod 12 of the lubricator 10 with back pressure valves (BPV) and Two Way Check Valves (TWCV) as well a running and pulling tools 90. As shown in FIG. 5 the dry rod 30 comprises a plurality of dry rod tube elements 36 that are connected to each other via high torque rating dry rod joints 38. The dry rod 30 is preferably a blank slim pipe with high torque connection 38 and locking mechanism preventing connection breaking out while rotating to set or retrieve tubing hanger plugs. The dry rod 30 will be made of dry rod tube elements 36 from different lengths to give flexibility spacing, as required based on the rig elevation. The dry rod 30 at the top end thereof comprises a second high torque connection 32 that is compatible with the lubricator's 10 polished rod first high torque connection 14. The lower most dry rod tube element 36, comprises at the bottom end thereof a socket head 31, for connection with a running or retrieving tool 90.

The through BOP lubricating system 1 may further comprises accessories for better handling of the through BOP lubricating system 1:

FIG. 8 shows a dry rod lifting cap 60 for lifting the dry rod 30. The dry rod lifting cap 60 comprises a threaded connection 62 for connection with the second high torque connection 32 of the dry rod 30 and a lug 64. The dry rod lifting cap 60 enables handle safely the dry rod pipe 30 while make-up and break out.

FIG. 9 shows a riser lifting cap 100 that allows to handle safely the riser 20 while make-up and break out. The riser lifting cap 100 comprises a lower connection 102 that can be connected to the upper end of the riser 20 and a lug 104 for lifting the riser 20.

FIG. 7 shows a C-plate 50 that acts as a false rotary table. The C-plate 50 is used while running the dry rod string 30 inside the riser 20.

The thru BOP lubrication system 1 provides solution of having pressure control system while running/pulling tubing hanger plugs thru Blow Out Preventers (BOP) 80. It is a reliable system, giving the ability of testing, controlling, & pumping through when necessary to control the well while running and retrieving tubing hanger plugs such as the back pressure valve 120.

The thru BOP lubrication system 1 has the following advantages: It provides full pressure control system during installing and retrieving the Back Pressure Valve (BPV) 120 or any other plugging device in the tubing hanger profile that will act as secondary well barrier. It further eliminates human exposure to hazard and injury. It eliminates the possibility of an environment impact. Further it is economically friendly and very reliable.

As shown in FIG. 10, the through BOP lubrication system 1 can also be run through a x-mas tree 110. This is particularly useful on offshore jack up rigs as the elevation will be high. In this embodiment the riser bottom sub element 40, 42 of the previous embodiments is replaced by a riser joint 27 that is compatible with an X-mas tree top flange 112.

By means of the thru BOP lubrication system 1 a method of testing a through BOP lubrication system can be performed as shown with respect to FIGS. 11 and 12. The method of testing comprises the following steps in the following sequence:

a. run the riser 20 to above tubing hanger 3, 4; orient bottom sub 40, 42 and land same on tubing hanger 3, 4;
b. close the bottom pipe rams 86;
c. run the dry rod 30;
d. connect the polished rod 12 of the lubricator 10 to the top of the dry rod 30;
e. connect the riser 20 with the lubricator 10; and close top pipe rams 84;
f. apply pressure through a kill line 82 between the BOP pipe rams 84, 86 and the lubricator lower packing 15; and
g. check the pressure at BOP gauges 88 and at the riser pressure gauge 29 arranged below the lubricator 10.

This allows for testing the extended lubrication system 1 while retrieving for example a H2TWCV.

Preferably, the method of testing a through BOP lubrication system further comprises the following steps:

a. run the riser 20 to above tubing hanger 3, 4, orient bottom sub 40, 42 and land same on tubing hanger 3, 4; and connect a H1 or H2 and running tool 80 to the bottom of dry rod 30;
b. close the bottom pipe rams 86;
c. run the dry rod 30;
d. connect the polished rod 12 of the lubricator 10 to the top of the dry rod 30;
e. connect the riser 20 with the lubricator 10 and close top pipe rams 84;
f. apply pressure through a kill line 82 between the BOP pipe rams 84, 86 and the lubricator lower packing 15; and
g. check the pressure at BOP gauges 88 and at the riser pressure gauge 29 arranged below the lubricator 10.

This allows for testing the extended lubrication system while running a H1 or H2 back pressure valve 120 or while retrieving for example a H1 tool.

The invention claimed is:

1. A through BOP lubrication system, which is capable to be run through a rig blow out preventer stack located below a rig floor, the through BOP lubrication system comprising:

a. a lubricator having a polished rod, wherein the polished rod at a bottom end thereof comprising a first high torque connection for connection with a dry rod;

b. a riser for connecting the lubricator with a well tubing, wherein the riser runs through the rig blow out preventer stack;

c. the dry rod, which is arranged within the riser; wherein the dry rod at a top end thereof comprises a second high torque connection, and wherein the dry rod is connected to the polished rod of the lubricator via the first and second high torque connections;

d. a kill line above BOP pipe rams and below a lubricator lower packing, and e. a BOP gauge and a riser pressure gauge for checking a pressure applied via the kill line, wherein the riser pressure gauge is arranged below the lubricator lower packing; wherein f. the riser comprises a plurality of riser tube elements, that are connected to each other via high pressure rating riser joints; and g. the lower most riser tube element comprises inlet holes for pressure testing the system via the kill line.

2. The through BOP lubrication system according to claim 1, wherein the top most riser tube element comprises the pressure gauge.

3. The through BOP lubrication system according to claim 1, wherein the riser further comprises a riser single bottom sub element, for connecting the riser with a single well tubing hanger plug profile.

4. The through BOP lubrication system according to claim 1, wherein the riser further comprises a riser dual bottom sub element, for connecting the riser with a dual well tubing hanger plug profile.

5. The through BOP lubrication system according to claim 1, wherein the dry rod comprises a plurality of dry rod tube elements, that are connected to each other via high torque rating dry rod joints.

6. The through BOP lubrication system according to claim 5, wherein the lower most dry rod tube element, comprises at the bottom end thereof a socket head, for connection with a running or retrieving tool.

7. The through BOP lubrication system according to claim 1, wherein the lubricator comprises a housing, an upper packing and a lower packing, wherein the upper and lower packings seal the polished rod against the housing.

8. The through BOP lubrication system according to claim 7, wherein the lubricator further comprises a hydraulically actuated middle packing that further seals the polished rod against the housing, wherein the middle packing is arranged in-between the lower and the upper packing of the lubricator.

9. The through BOP lubrication system according to claim 1, further comprising a C-plate.

10. The through BOP lubrication system according to claim 1, further comprising a dry rod lifting cap for lifting the dry rod.

11. The through BOP lubrication system according to claim 1, further comprising a riser lifting cap for lifting the riser.

12. A method of testing a through BOP lubrication system, comprising the following steps in the following sequence:

a. run a riser to above a tubing hanger, orient a bottom sub and land the bottom sub on the tubing hanger;

b. close BOP bottom pipe rams;

c. run a dry rod;

d. connect a polished rod of a lubricator to the top of the dry rod;

e. connect the riser with the lubricator; and close top pipe rams;

f. apply pressure through a kill line above the BOP pipe rams and below a lubricator lower packing; and g. check pressure at BOP gauges and at a riser pressure gauge, wherein the riser pressure gauge is arranged below the lubricator lower packing.

13. The method of testing a through BOP lubrication system, according to claim 12, further comprising the following step:

h. after step a, connect a running tool to the bottom of the dry rod.

* * * * *